United States Patent [19]

Geffriaud et al.

[11] Patent Number: 4,902,171

[45] Date of Patent: Feb. 20, 1990

[54] PROCESS FOR REINFORCING A DRIVEN TUBULAR PILING, THE PILING OBTAINED BY THIS PROCESS, AN ARRANGEMENT FOR IMPLEMENTING THE PROCESS

[75] Inventors: Jean-Paul Geffriaud, Paris; Hervé Barthelemy, Croissy-sur-Seine, both of France

[73] Assignee: Soletanche, Nantarre, France

[21] Appl. No.: 153,227

[22] Filed: Feb. 8, 1988

[30] Foreign Application Priority Data

Feb. 9, 1987 [FR] France ..... 87 01541

[51] Int. Cl.[4] ..... E02D 3/12

[52] U.S. Cl. ..... 405/232; 405/269

[58] Field of Search ..... 405/237, 238, 248, 243, 405/252, 253, 269, 233, 232, 241, 242, 229, 230, 267, 225, 244

[56] References Cited

U.S. PATENT DOCUMENTS

| | | | |
|---|---|---|---|
| 1,729,422 | 9/1929 | Gleasner | 405/248 |
| 1,746,848 | 2/1930 | Bates | 405/237 X |
| 1,868,494 | 7/1932 | Collins | 405/225 |
| 2,403,643 | 7/1946 | Dresser | 405/267 |
| 3,245,222 | 4/1966 | Gallaup | 405/267 |
| 3,453,832 | 7/1969 | Rehmar | 175/323 |
| 3,842,608 | 10/1974 | Turzillo | 405/239 X |
| 3,878,687 | 4/1975 | Tragesser | 405/225 |
| 4,065,928 | 1/1978 | Takagi et al. | 405/267 |
| 4,157,287 | 6/1979 | Christenson | 405/232 X |
| 4,212,565 | 7/1980 | Watabe | 405/267 X |
| 4,412,759 | 11/1983 | Britton et al. | 405/225 |
| 4,588,327 | 5/1986 | Lin | 405/240 X |

*Primary Examiner*—Dennis L. Taylor

*Attorney, Agent, or Firm*—Schweitzer & Cornman

[57] ABSTRACT

The invention relates to a process for the reinforcement of anchoring pilings used particularly in the oil-drilling industry, where a tubular steel piling (1) is driven into the ocean floor. Successive injections of a grout which can harden are made into the ground (7) which is contained inside the piling.

5 Claims, 1 Drawing Sheet

PROCESS FOR REINFORCING A DRIVEN TUBULAR PILING, THE PILING OBTAINED BY THIS PROCESS, AN ARRANGEMENT FOR IMPLEMENTING THE PROCESS

BACKGROUND OF THE INVENTION

The present invention has as its object a process for the reinforcement of anchoring pilings used particularly in the oil-drilling industry, the pilings obtained by this process, and an arrangement for implementing the process.

It is known, particularly for the construction of oil-drilling platforms in the ocean, to drive tubular steel pilings with a large diameter into the ocean floor to a great depth, to withstand the forces which can be considerable.

It is also known to inject a cement grout between the external wall of such a piling and the ground which surrounds it, in such a way as to increase the friction between the piling and the ground.

Such injections are generally carried out at pressures below 10 bar, taking into account the fact that they occur in an open area, and that the grout can expand to a considerable volume.

SUMMARY OF THE PRESENT INVENTION

The present invention aims at treating the ground which is located inside the piling, to give it a much higher consistency and to extensively make it a unit with the tubular piling, in such a way that the latter acts in the same manner as a drilled concrete piling.

Thus, thanks to the invention, the forces which the piling can withstand are significantly increased. The vertical compression forces are increased by the fact that the lower end of the piling rests on the ground not just on its periphery, but on its entire surface, since the ground inside the tubular steel piling has become one piece with the latter. The vertical traction forces are also considerably increased, by the fact that in order to raise the piling, it is necessary to raise the entire mass of the ground which forms one piece with the interior of the piling, in addition to the friction.

When it is implemented, the invention also presents the advantage of not noticeably changing the conditions for driving the tubular piling, and of allowing any subsequent drilling inside the piling, as is the case with driven tubular pilings not treated according to the invention.

The process according to the present invention is characterized by the fact that after having driven a tubular steel piling in the conventional manner, successive injections of a grout which can harden are made into the ground which is contained inside the piling.

In accordance with a preferred embodiment of the invention, the successive injections are carried out starting from the base of the piling and rising in steps, up to the upper part of the ground.

In accordance with a preferred embodiment of the invention, and principally for injections which are carried out at the lower part of the piling, injection of the grout is interrupted either when the injection pressure has reached a maximum desired value which can be between 100 and 200 bar, for example, or when this pressure is not reached at the moment when a given volume of grout, which is determined as a function of the nature of the soil, the desired degree of compaction and the spacing of the injection points, is injected, with the injection being interrupted when one or the other of these conditions is met.

In accordance with the invention, when the injection is interrupted without the maximum pressure having been reached, in other words when a given volume of grout has been injected, a time sufficient for the grout to set (in other words to solidify) is allowed to elapse, then another injection is carried out in the same zone, and this is continued until the injection pressure reaches the maximum desired value.

In accordance with the invention, if the injection has been interrupted at a given point after the injection pressure has reached the maximum desired value, the injection point is moved upward a distance which can be equal, for example, to one to four times the diameter of the tubular piling, and successive injections are started again.

Thanks to this implementation of the process according to the invention, it is easy to create a sealed plug consolidated with the inside of the piling, which makes it possible to carry out injections under high pressure along the entire height of the piling, which injections strongly consolidate the ground which is located inside the piling, and make it a unit with the wall of the latter, without the grout being expended uselessly in the ground which surrounds the piling.

The grout which is used in accordance with the invention, to be injected inside the piling, can be composed of a grout or a mortar of conventional cement, or also of a fluid which does not contain any cement, but rather contains a resin or a gel which can harden to assure consolidation of the ground inside the tubular piling.

The present invention also has as its object a driven tubular steel piling which is characterized by the fact that the ground contained in its interior has been consolidated by high-pressure injection of a grout which hardens, with the ground consolidated in this way having been made into a unit with the tubular piling.

The present invention also has as its object an arrangement for implementing the process defined above, characterized by the fact that it comprises at least one duct starting from the base and ending at the upper part of the piling, arranged according to a generatrix of the tubular piling, which is connected at different points of its progression on the interior of the piling by anti-return valves, an injection line which can be engaged by the upper part of the aforementioned duct, the said line being equipped with at least one inflatable stop-valve to allow successive injections of the grout on the interior of the tubular piling through the anti-return valves.

In accordance with the invention, the duct which is intended to contain the injection line can be situated either at the interior or the exterior of the tubular piling, and is preferably fixed on the wall of the latter.

In a preferred embodiment of the invention, the injection line is equipped with two inflatable stop-valves located below and above the injection orifices of the line, in such a way as to allow the grout to be sent through the anti-return valve in question, located between the two inflatable stopvalves, under pressure.

In a simplified variation, the injection line can have only a single inflatable stop-valve located above the injection orifice of the line, in which case, it is indispensable to start the injection of the grout starting from the bottom, and then to raise the grout line in steps, to inject the grout through the different anti-return valves.

In the case where an injection line equipped with two inflatable stopvalves is used, when injection through a given anti-return valve has been completed, it is indicated, in accordance with the invention, to deflate the upper stop-valve and possibly the lower stop-valve, and to send water under pressure into the injection line, to proceed with washing out the grout which is located in the vicinity of the anti-return valve, as well as in the duct between the two stop-valves. In this way, obstruction of this zone by the grout is prevented, and it is therefore possible to carry out further injections through the same anti-return valve subsequently, if this proves to be necessary.

DESCRIPTION OF THE DRAWINGS

For the purpose of making the invention easier to understand, several embodiments will now be described as examples for the sake of illustration, and without any limiting character, with reference to the drawings, where.

DETAILED DESCRIPTION OF INVENTION

Figure 1:
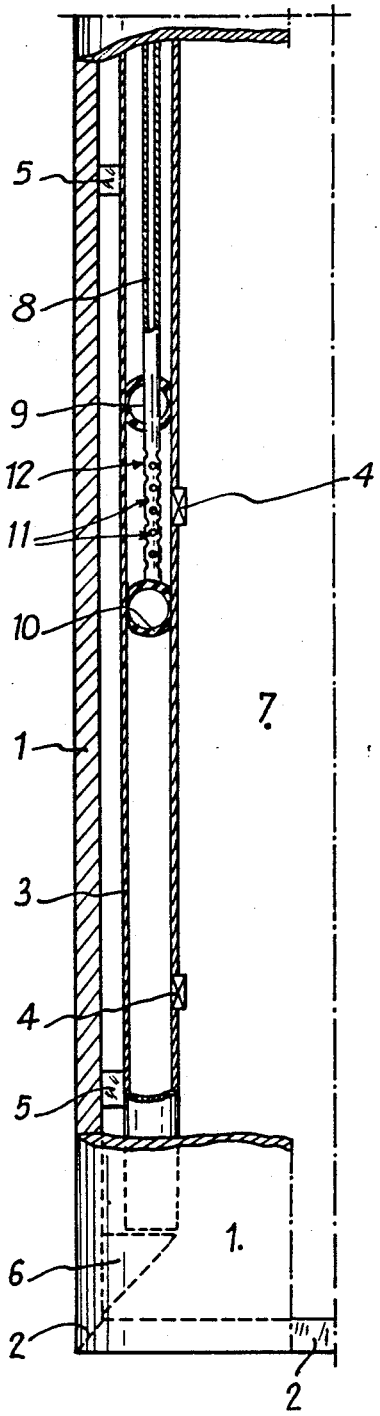
FIG. 1 represents a partial break-away view of a tubular piling equipped with an injection arrangement according to the invention.

FIG. 1 shows the left lower part of a tubular steel piling intended to be driven into the ground.

This piling is essentially composed of a tubular wall 1 which is equipped, at its lower part, with a bevel 2 which is intended to facilitate driving it into the ground.

Taking into account the great heights which are often necessary for such pilings, the latter are constituted of a series of tubular elements such as 1 which are connected with one another in a conventional manner.

In accordance with a first embodiment of the invention, a duct 3, equipped with anti-return valves 4 at different locations along its length, is fastened to the interior wall of the piling by attachment pieces 5, with the assembly being carried out by welding, for example.

The duct 3 is closed off at its lower part, and its upper part, not shown, opens out at the upper part of the piling.

A protective shoe 6 is arranged on the interior wall of the piling, to protect the duct 3 when the piling is driven.

The distance separating two anti-return valves 4 is chosen as a function of the characteristics of the ground and the nature of the grout to be injected.

In a general manner, the distance between two adjacent anti-return valves can be equal to approximately one to four times the diameter of the piling. It is advantageous for this spacing to be reduced at the base of the piling and greater in the part located above the base.

The piling which has just been described is driven in a conventional manner, being sunk into the ground by means of a ram which strikes its upper part.

The duct 3 preferably has an essentially circular cross-section in the vicinity of the anti-return valves 4 where it must be continuous.

In the zones situated between the anti-return valves and, in particular, in the connecting zones between two adjacent elements of the tubular wall 1, the canalization 3 does not have to have an essentially circular cross-section, and it is sufficient that the injection line can be activated along the entire length of the duct 3.

In the same way, the duct 3 can end at the upper part, in the vicinity of the surface of the ground into which the piling is sunk.

FIG. 1 shows how an injection line 8 is placed in the duct 3, in such a way that the inflatable stop-valves 9 and 10 are located on opposite sides of an anti-return valve 4.

In this manner, what is achieved is that the grout which is sent through the line 8 and which flows through the orifices 11 between the two stop-valves 9 and 10 progressively fills the volume 12 located between the two stop-valves and allows the pressure which develops there to open the anti-return valve 4, which allows the grout to enter the ground located inside the piling under pressure, thereby consolidating it.

Figure 2:
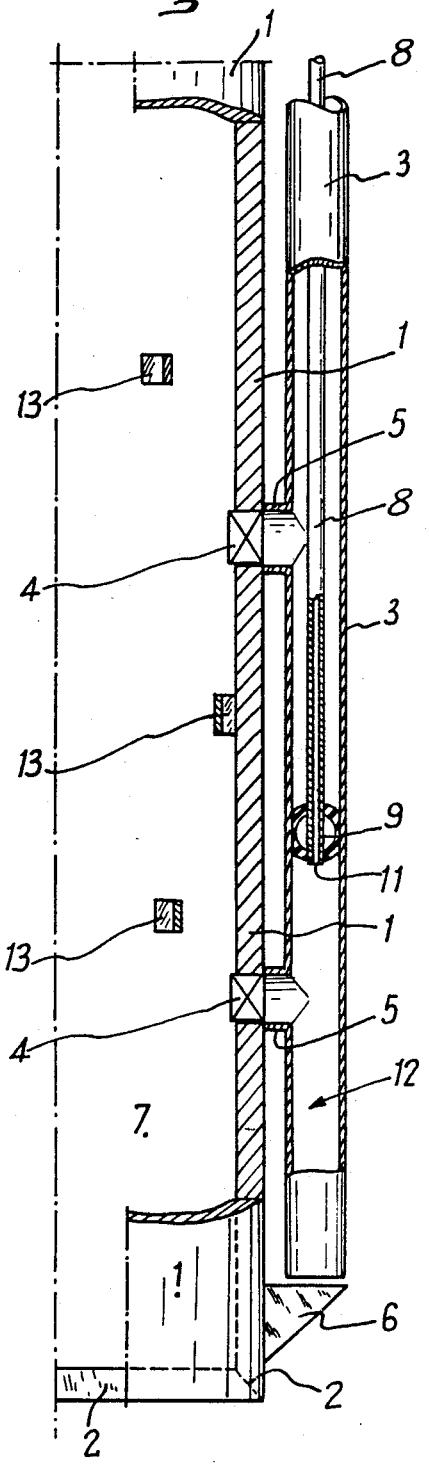
FIG. 2 represents a partial break-away view of a variant of the arrangement according to FIG. 1.

FIG. 2 shows a variant of the arrangement of FIG. 1, in which the lower right part of a piling is seen, with the tubular wall 1 also being equipped with a bevel 2 at its lower part, to facilitate driving it into the ground, and supporting a duct 3 on the exterior of the piling.

This duct 3 is connected, on the interior of the piling, with anti-return valves 4 arranged in the wall 1, with openings 5 which simultaneously assure that the duct 3 is attached to the piling and that the duct is connected with the anti-return valves 4.

As in the previous case, a deflector 6 placed below the duct 3 prevents deterioration of the latter while the piling is being driven.

In the embodiment shown in FIG. 2, the injection line 8 which is introduced into the duct 3 comprises a single inflatable stop-valve 9.

In FIG. 2, the position of the injection line which corresponds to use of the lower anti-return valve has been shown. For this, the stop-valve 9 is placed above the anti-return valve and then is inflated, in such a way as to create a sealed chamber 12 which, when it is put under pressure by means of the grout, makes it possible to evacuate the latter through the anti-return valve, with the grout therefore being injected into the mass of the ground which comprises the interior of the circular wall of the piling.

When injection through the anti-return valve 4 has been completed, it is sufficient to raise the stop-valve 9 above the following anti-return valve is an upward direction, and then it is possible to start the operation again.

To implement the process according to the invention, after the piling has been driven, one proceeds with injections of grout under pressure, through the anti-return valves which are arranged at intervals along the height of the piling.

In accordance with the invention, it is advantageous, in particular at the base of the piling, to interrupt the injection when the maximum injection pressure desired (which can be 100 to 200 bar, for example) has been reached, or when a volume of grout which essentially corresponds to the residual space of the ground which is located above and below the anti-return valve up to a distance of approximately one or two diameters of the piling, for example, is being injected.

In the latter case, one waits until the grout has partially set, then successive injections through the same anti-return valve are started again, until the maximum desired pressure for the injection has been reached, allowing the grout to harden each time.

In this manner, the lower part of the piling is made into a solid plug which blocks the base of the piling, which makes it possible to easily achieve the maximum desired pressure for injection along the entire height of the piling.

In accordance with the invention, in the case where several injections are to be carried out successively through the same anti-return valve, it is preferable to inject water under pressure in the injection line, to wash out the valves.

For this, it is indicated to use an injection line with two stopvalves, as shown in FIG. 1, because by deflating the upper stop-valve and sending the current of water through the orifices 11, it is possible to wash the duct 3 and the section behind the anti-return valve 4, with the washing water being evacuated at the upper part of the duct 3.

In this way, a grout which hardens can be injected into the ground contained inside the cylindrical wall 1 of the piling, this grout being injected under pressure, for example 100 to 200 bar, and having the advantage, on the one hand, of making the mass of ground which is contained inside the piling rigid and solid, and, on the other hand, considerably increasing the friction of this mass of ground with regard to the interior surface of the piling.

This friction can also be increased by arranging protuberances on the interior of the wall 1 of the piling, which are sufficiently small not to interfere with driving the piling, but which are large enough to assure axial locking of the ground contained inside the piling with regard to the latter.

Such protuberances have been shown schematically in FIG. 2 where they are indicated by reference number 13.

It can be seen that thanks to the invention, it is possible to considerably consolidate the ground which is contained inside a driven tubular piling, in a manner that is economical and easy to implement, resulting in a considerable increase in the forces which such a piling can withstand.

It is evident, in particular, that the piling treated in accordance with the invention can withstand very large forces, particularly towards the bottom, due to the fact that it is supported on the ground on its entire cross-section and not just on its periphery as might be the case with pilings known until now, in particular in soil which has deteriorated during pile-driving, such as carbonate soil, for example.

It is also evident that the breakage resistance is considerably increased,due to the fact that the piling forms a unit with the entire mass of the ground which is contained inside the wall 1.

Finally, it will be noted that the process of reinforcing the piling according to the invention does not change the traditional method of driving tubular pilings and that, as with pilings used previously, it remains possible to undertake any drilling in the ground located inside the piling which might be necessary.

We claim:

1. Apparatus for injecting grout into a driven tubular piling comprising at least one duct extending from the base of said piling at least the surface of the ground into which said piling has been driven; a grout injection line disposed within said duct and containing at least one grout delivery orifice therein; at least one inflatable valve disposed within said grout injection delivery line to permit successive injections of grout into the interior of said tubular piling through check valves communicating between said duct and the interior of said driven piling.

2. An apparatus according to claim 1, characterized by the fact that said duct is disposed within said driven piling.

3. An apparatus according to claim 1, characterized by the fact that said duct is disposed outside of said driven piling.

4. An apparatus according to claim 1, characterized by the fact that said grout injection line is provided with two inflatable valves which straddle the injection orifice of said injection line.

5. A method for the reinforcement of pilings in which a tubular steel piling is driven into the ground entrapping soil therein, comprising successive injections of a hardenable grout under pressure into the soil contained within the driven piling, said injections being carried out in layered zones in successive phases through check valves arranged at injection points spaced along the length of the piling, the upper limits of said zones being defined by inflatable valves.

* * * * *